US008166591B2

(12) United States Patent
Dunn et al.

(10) Patent No.: US 8,166,591 B2
(45) Date of Patent: May 1, 2012

(54) APPARATUS AND METHOD FOR WASH FLUID RECIRCULATION IN A WASHING MACHINE

(75) Inventors: David Scott Dunn, Smithfield, KY (US); Alaknanda Acharya, Hyderabad (IN); Alexander Boris Leibman, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/963,881

(22) Filed: Dec. 9, 2010

(65) Prior Publication Data

US 2012/0060569 A1 Mar. 15, 2012

(51) Int. Cl.
*D06F 39/08* (2006.01)
*D06F 33/00* (2006.01)

(52) U.S. Cl. ..... 8/159; 68/12.19; 68/23.5; 68/207

(58) Field of Classification Search ..... 8/158, 159; 68/207, 12.19, 23.5, 58
See application file for complete search history.

(56) References Cited

U.S. PATENT DOCUMENTS

| | | | | |
|---|---|---|---|---|
| 3,807,636 | A * | 4/1974 | Fackler | 239/226 |
| 4,757,699 | A | 7/1988 | Arreghini et al. | |
| 5,386,941 | A * | 2/1995 | Haynes | 239/427.3 |
| 5,758,377 | A | 6/1998 | Cimetta et al. | |
| 5,967,760 | A * | 10/1999 | Howie et al. | 417/80 |
| 6,578,591 | B1 * | 6/2003 | Eksert et al. | 134/107 |
| 7,421,752 | B2 | 9/2008 | Donadon et al. | |
| 2006/0000030 | A1 * | 1/2006 | Shaffer | 8/159 |

* cited by examiner

*Primary Examiner* — Joseph L Perrin
(74) *Attorney, Agent, or Firm* — Dority & Manning, P.A.

(57) ABSTRACT

Apparatus and methods for recirculating wash fluid in a washing machine are disclosed. The washing machine includes a wash tub and a wash basket rotatably supported within the wash tub. The washing machine can include a jet pump for recirculation of wash fluid through the wash basket and wash tub. The inlet of the jet pump is in fluid communication with a wash fluid supply line and the outlet of the jet pump is in fluid communication with the wash tub. The jet pump includes a suction port coupled to a recirculation line in fluid communication with the wash tub. The jet pump draws wash fluid from the wash tub through the recirculation line and returns the wash fluid through the outlet of the jet pump to the wash basket according to the Venturi effect when wash fluid flows through the inlet of the jet pump.

16 Claims, 3 Drawing Sheets

APPARATUS AND METHOD FOR WASH FLUID RECIRCULATION IN A WASHING MACHINE

FIELD OF THE INVENTION

The present disclosure relates generally to washing machines, and more particularly to apparatus and methods for reducing water usage and energy consumption in a washing machine.

BACKGROUND OF THE INVENTION

Washing machines typically include a cabinet which receives a stationary tub for containing wash and rinse water. A wash basket is rotatably mounted within the wash tub, and an agitating element is rotatably positioned within the wash basket. A drive assembly and a brake assembly can be positioned with respect to the wash tub and configured to rotate and control the agitation of the wash basket to cleanse the wash load loaded into the wash basket. Upon completion of a wash cycle, a pump assembly can be used to rinse and drain the soiled water to a draining system.

It has become increasingly desirable to reduce water consumption in washing machine operations. Large wash loads, however, have typically required an increased amount of water to provide adequate cleansing and rinsing of the large wash loads. To reduce water consumption, washing machines have used recirculation systems to remove water from the wash tub and return the water to the wash basket so that a reduced amount of water can be continuously poured over wash loads during a fill cycle. These recirculation systems, however, typically require recirculation pumps that consume energy to remove water from the wash tub and return the water to the wash basket.

Thus, a need exists for an apparatus and method for reducing water consumption in washing machines that also operates with reduced energy demands.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a washing machine. The washing machine includes a wash tub and a wash basket rotatably mounted in the wash tub. The wash basket has a wash basket opening for receiving wash fluid and a wash load therein. The washing machine further includes a jet pump having an inlet port in fluid communication with a wash fluid supply line, an outlet port in fluid communication with the wash basket opening, and a suction port in fluid communication with a recirculation line.

Another exemplary embodiment of the present disclosure is directed to a method for recirculating wash fluid in a washing machine. The washing machine includes a wash tub and a wash basket rotatably mounted within the wash tub. The method includes providing wash fluid through an inlet of a jet pump; delivering wash fluid to the wash tub through an outlet of the jet pump; drawing wash fluid from the wash tub through a recirculation line into a suction portion of the jet pump; and returning the drawn wash fluid to the wash tub through the outlet of the jet pump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
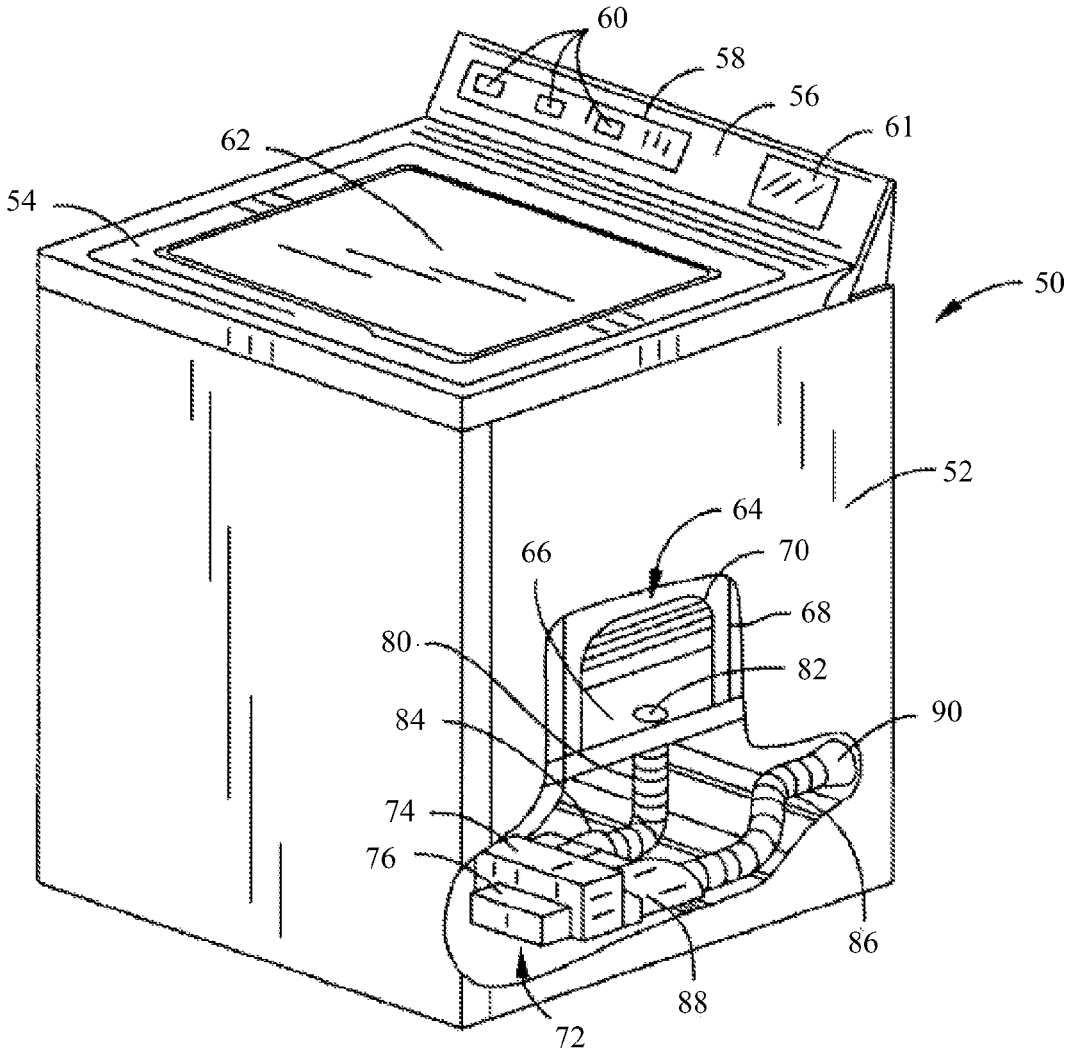
FIG. 1 is a perspective cutaway view of an exemplary top load washing machine according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to an apparatus and method for recirculating wash fluid in a washing machine. The washing machine includes a jet pump for recirculation of wash fluid during a filling cycle, washing cycle, rinsing cycle, or other cycle for the washing machine. The inlet of the jet pump is in fluid communication with a wash fluid supply line and the outlet of the jet pump is in fluid communication with the wash tub. The jet pump includes a suction port coupled to a recirculation line that is in fluid communication with the wash tub.

As wash fluid flows through the inlet of the jet pump, a pressure differential is created at the suction port of the jet pump according to the Venturi effect. The pressure differential draws water from the wash tub through the recirculation line. The water drawn from the wash tub is returned to the wash tub through the outlet of the jet pump. The water returns to the wash tub and is again drawn into the recirculation line, carrying out recirculation of water in the washing machine. In this manner, embodiments of the present disclosure can wet large wash loads with a reduced amount of wash fluid and with less energy consumed when compared to conventional recirculation pump systems.

FIG. 1 is a perspective view partially broken away of an exemplary vertical axis washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and other items of interest to machine users. A lid 62 is mounted to cover 54 and is rotatable about a hinge (not shown) between an open position (not shown) facilitating access to wash tub 64 located within cabinet 52, and a closed position (shown in FIG. 1) forming an enclosure over wash tub 64.

Wash tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in fluid communication with outlet 90.

Figure 2:
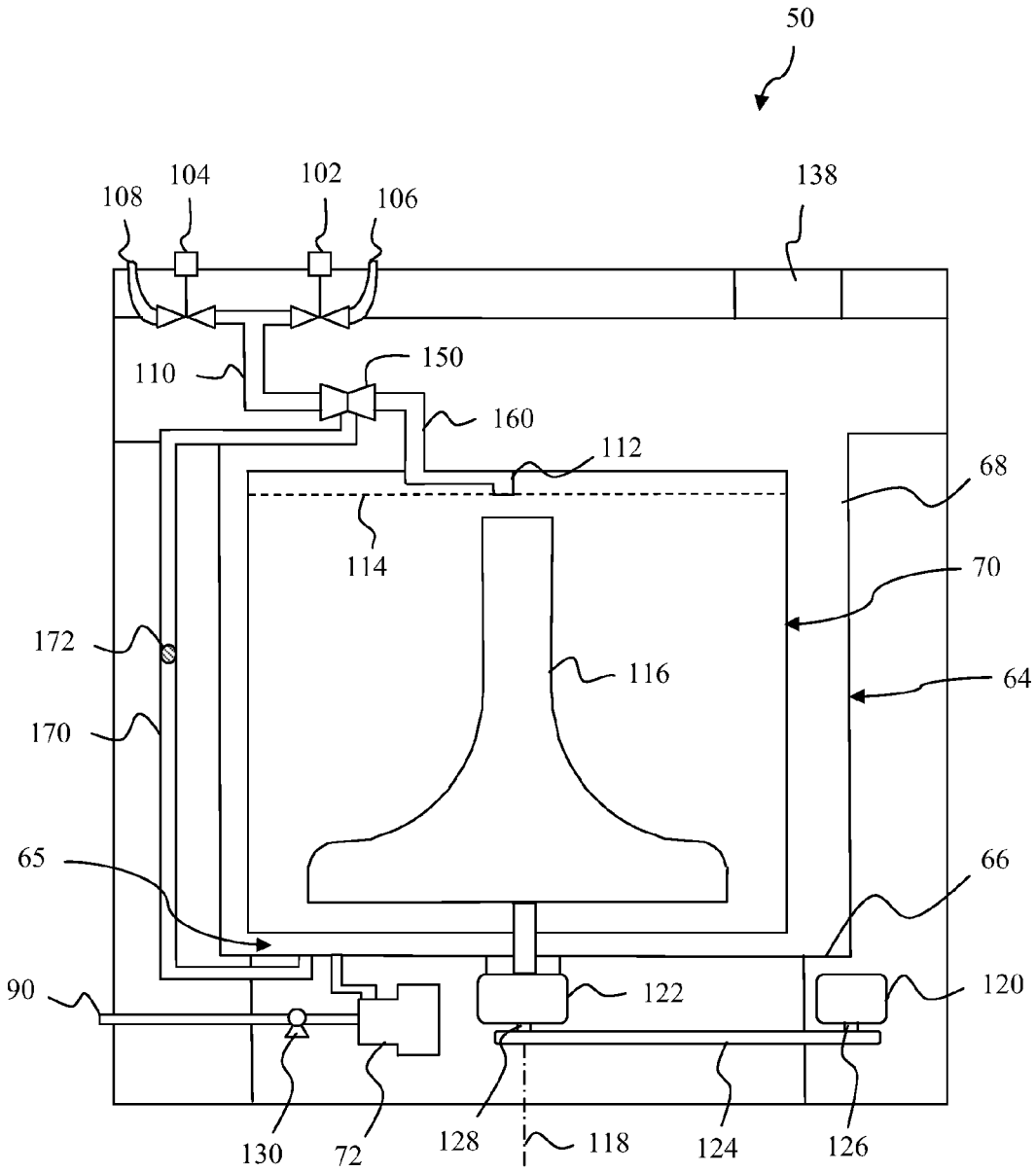
FIG. 2 is a front schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 68 and the tub bottom 66. Basket 70 includes an opening for receiving wash fluid and a washload therein. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a wash fluid supply line 110. As will be discussed in detail below, wash fluid supply line 110 delivers fluid through jet pump 150 and basket inlet tube 160 such that fluid is dispersed from inlet tube 160 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another and discharge at a predetermined angle to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 may also include a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, laundry items are loaded into basket 70, and washing operation is initiated through operator manipulation of control input selectors 60 (shown in FIG. 1). Wash tub 64 is filled with water and mixed with detergent to form a wash fluid, and contents of the basket 70 are agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Laundry items are then rinsed and portions of the cycle repeated, including the agitation phase, depending on the particulars of the wash cycle selected by a user.

To conserve water resources, it can be desirable to draw wash fluid from the wash tub and return the wash fluid to the wash basket so that a large wash load can be adequately cleansed and rinsed with a reduced amount of water. As shown in FIG. 2, a jet pump 150 is used to recirculate wash fluid from wash tub 64 through a recirculation line 170 back to wash basket 70. Recirculation line 170 can have a first end in fluid communication with jet pump 150 and a second end in fluid communication with wash tub 64, such as at wash tub sump 65. In a particular embodiment, wash tub sump 65 is located at the annulus between the wash tub 64 and wash basket 70.

When wash fluid is provided through jet pump 150, wash fluid is drawn from the wash tub 64 through recirculation line 170 and through jet pump 150 back to the wash basket through basket inlet tube 160. In this manner, washing machine 50 can cleanse and rinse a large wash load with a reduced amount of wash fluid by recirculating the wash fluid over the wash load numerous times thereby increasing the saturation of the wash load with a reduced amount of water.

Figure 3:
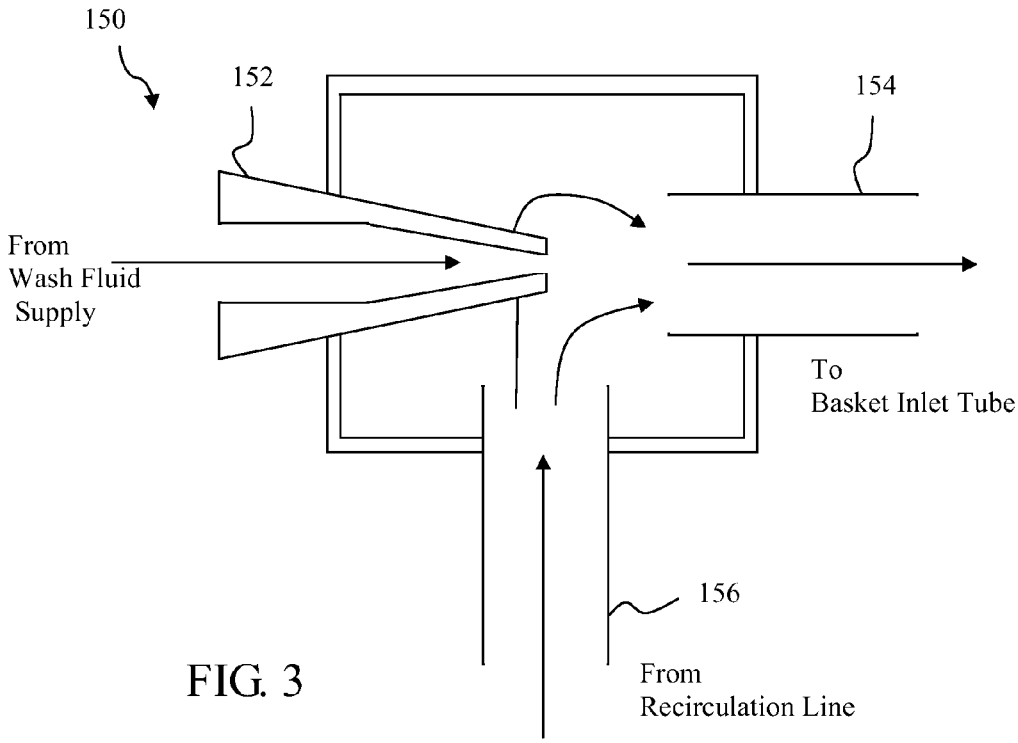
FIG. 3 is a close up view of an exemplary jet pump according to an exemplary embodiment of the present disclosure.

Jet pump 150 is able to recirculate wash fluid through washing machine 50 using reduced energy resources by operating according to the Venturi effect. FIG. 3 provides a close up schematic view of an exemplary jet pump 150. Jet pump 150 includes three ports: an inlet port 152, an outlet port 154, and a suction port 156. The inlet port 152 can be in fluid communication with the wash fluid supply line 110. The outlet port 154 can be in fluid communication with the basket inlet tube 160. The suction port 156 can be in fluid communication with recirculation line 170.

Inlet port 152 generates a pressure differential at suction port 156 by increasing the velocity of wash fluid flowing through the inlet port 152. In particular, the tapered inlet port 152 increases the velocity of the wash fluid. The increase in velocity of the wash fluid causes the kinetic energy of the wash fluid to increase causing a corresponding decrease in pressure. The decrease in pressure generates a pressure differential at suction port 156. The pressure differential draws wash fluid from the recirculation line 170 into the jet pump 150. The wash fluid from the inlet port 152 and the suction port 156 is delivered to the basket inlet tube through the outlet port 154 of the jet pump 150.

Because the jet pump 150 operates according to the Venturi principle, no power or energy is required to draw fluid from wash tub 64. Rather the pressure differential created by providing the wash fluid through the inlet port 152 of the jet pump 150 draws the wash fluid through recirculation line 170. In this manner, the jet pump 150 provides for the recirculation of wash fluid in a washing machine that conserves water and consumes less energy than conventional pump driven recirculation systems.

In the exemplary embodiment illustrated in FIG. 2, the jet pump 150 is located above the opening of wash basket 70. In other embodiments, however, the jet pump 150 can be located below the opening of wash basket 70, such as closer to wash tub sump 65. In a particular embodiment, the recirculation line 170 can include a filter 172. Filter 172 can be used to filter dirt and other debris from the wash fluid as it recirculates through recirculation line 170 and jet pump 150. The filter could also be located at the inlet of the recirculation line such that it self cleans when the tub is drained by the pump.

Figure 4:
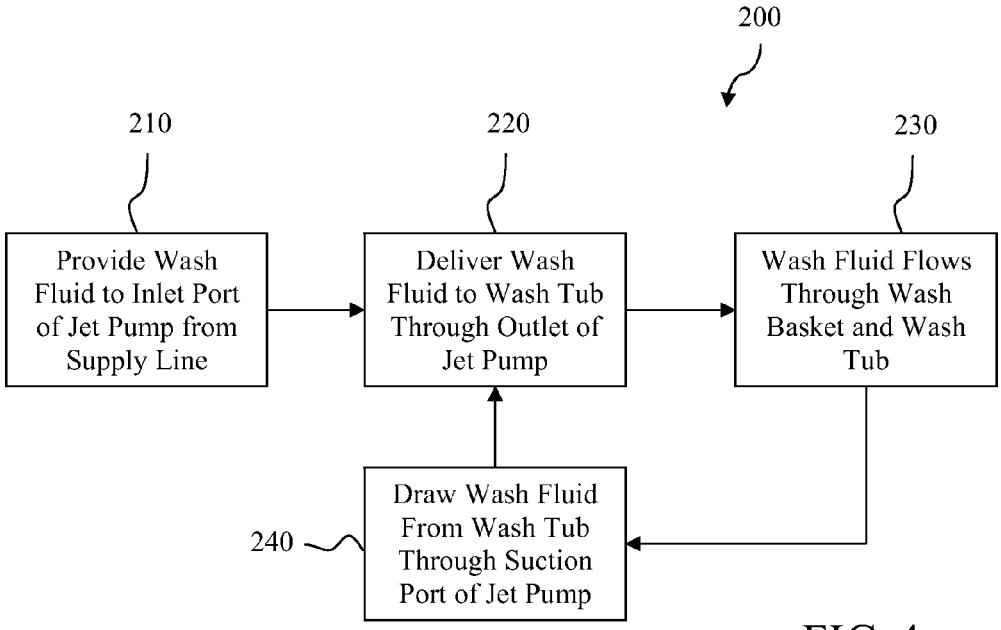
FIG. 4 is flow diagram of exemplary process steps for a method according to an exemplary embodiment of the present disclosure.

FIG. 4 is a flow diagram of exemplary process steps for a method 200 according to an exemplary embodiment of the present disclosure. At 210, a wash fluid is provided to the inlet port of a jet pump. The wash fluid can be provided from an external wash fluid supply through at least one of a hot water valve and a cold water valve and a wash fluid inlet line. At 220, wash fluid is provided to a wash basket of a washing machine through the outlet port of the jet pump. At 230, wash fluid flows through the wash basket and wash tub over a wash load until it collects at a low point of the wash tub, such as at the wash tub sump.

At 240, the wash fluid is drawn from the wash tub through a recirculation line to the suction port of the jet pump. In particular, the jet pump operates according to the Venturi effect such that as wash fluid is provided through the inlet of the jet pump, a pressure differential is created at the suction port of the jet pump that is sufficient to draw the wash fluid from the wash tub into the recirculation line. At 220, the wash fluid that had been drawn from the wash tub is returned to the wash basket through the outlet of the jet pump. In this manner, the method 200 provides for the recirculation of water through a washing machine using reduced energy resources.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for recirculating wash fluid in a washing machine, the washing machine comprising a wash tub and a wash basket rotatably mounted within said wash tub, the method comprising:

providing wash fluid from an external water source through an inlet port of a jet pump;

delivering wash fluid to the wash tub through an outlet port of the jet pump; and drawing wash fluid from the wash tub through a recirculation line into a suction port of the jet pump; and returning the drawn wash fluid to the wash tub through the outlet port of the jet pump;

wherein providing wash fluid from an external water source is sufficient to generate a pressure differential in the jet pump sufficient to draw the water from the wash tub through the recirculation line.

2. The method of claim 1, wherein drawing wash fluid from the wash tub comprises drawing wash fluid from a wash tub sump.

3. A washing machine, comprising:

a wash tub;

a wash basket rotatably mounted in said wash tub, said wash basket having a wash basket opening for receiving wash fluid and a wash load therein; and a jet pump having an inlet port in fluid communication with an external wash fluid supply line, an outlet port in fluid communication with said wash basket opening, and a suction port in fluid communication with a recirculation line wherein said jet pump is configured to generate a pressure differential sufficient to draw wash fluid from said wash tub through said recirculation line when wash fluid flows through said inlet port from the external supply line.

4. The washing machine of claim 3, wherein said recirculation line has a first end in fluid communication with said suction port of said jet pump and a second end in fluid communication with said wash tub.

5. The washing machine of claim 3, wherein said jet pump is configured to deliver wash fluid through said outlet port of said jet pump to said wash tub.

6. The washing machine of claim 3, wherein said jet pump operates according to the Venturi effect.

7. The washing machine of claim 3, wherein said jet pump is located above the wash basket opening.

8. The washing machine of claim 3, wherein said jet pump is located below the wash basket opening.

9. The washing machine of claim 3, wherein said recirculation line comprises a filter.

10. The washing machine of claim 3, wherein said recirculation line is in fluid communication with a tub sump.

11. A washing machine, comprising:

a wash tub having a tub sump;

a wash basket rotatably mounted within said wash tub;

a wash fluid supply line configured to receive wash fluid from an external water source;

a basket inlet tube configured to deliver wash fluid to said wash basket;

a recirculation line in fluid communication with said wash tub; and a jet pump having an inlet port in fluid communication with said wash fluid supply line, an outlet port in fluid communication with said basket inlet tube, and a suction port in fluid communication with said recirculation line;

wherein said jet pump is configured to generate a pressure differential sufficient to draw wash fluid from said wash tub through said recirculation line when wash fluid flows through said inlet port from the external water source.

12. The washing machine of claim 10, wherein said jet pump is configured to deliver wash fluid through said outlet port of said jet pump to said basket inlet tube.

13. The washing machine of claim 10, wherein said wash fluid supply line comprises at least one of a hot water valve and a cold water valve.

14. The washing machine of claim 10, wherein said recirculation line comprises a filter.

15. The washing machine of claim 10, wherein said basket inlet tube delivers water to said wash tub through a nozzle assembly or spray fill conduit.

16. The washing machine of claim 10, wherein said recirculation line is in fluid communication with the tub sump.

* * * * *